US006123118A

United States Patent [19]

Nanaji

[11] Patent Number: 6,123,118

[45] Date of Patent: Sep. 26, 2000

[54] METHOD FOR VAPOR RECOVERY

[75] Inventor: Seifollah S. Nanaji, Greensboro, N.C.

[73] Assignee: Gilbarco Inc., Greensboro, N.C.

[21] Appl. No.: 09/447,372

[22] Filed: Nov. 23, 1999

Related U.S. Application Data

[62] Division of application No. 08/909,284, Aug. 11, 1997.

[51] Int. Cl.[7] ..... B65B 31/00

[52] U.S. Cl. ..... 141/4; 141/5; 141/7; 141/44; 141/52; 141/59; 141/83; 141/98; 141/302; 141/311 R

[58] Field of Search ..... 141/4, 5, 7, 37, 141/39, 44, 47, 52, 59, 83, 192, 98, 197, 302, 311 R

*Primary Examiner*—Henry J. Recla
*Assistant Examiner*—Timothy L. Maust
*Attorney, Agent, or Firm*—Coats & Bennett, P.C.

[57] ABSTRACT

A fuel dispenser's vapor recovery system nozzle capable of responding to the presence of an onboard vapor recovery system (ORVR) in an automobile. The invention includes a vapor recovery nozzle having a vapor passage in its nozzle spout and a vapor inlet in communication with the vapor passage. The spout includes a moveable seal mounted on the spout with the seal having a first position adjacent to the plurality of vapor inlets and a second position covering the vapor inlets so as to substantially block the passage of vapors through the vapor inlets. The seal may be biased in the second position.

3 Claims, 6 Drawing Sheets

METHOD FOR VAPOR RECOVERY

This is a divisional application claiming the benefit of application Ser. No. 08/909,284 filed Aug. 11, 1997, entitled Onboard Vapor Recovery Detection Nozzle in the name of Seifollah S. Nanaji, pending.

BACKGROUND OF THE INVENTION

The present invention relates generally to vapor recovery systems associated with both automobiles and fuel dispensers. More particularly, the invention relates to a vapor recovery system nozzle capable of detecting the presence of an onboard vapor recovery system in an automobile. For the past several years, the environmental regulations have imposed limits on the amount of fuel vapor released into the atmosphere during the refueling of a motor vehicle. During a non-vapor-recovery fueling operation, incoming fuel displaces fuel vapor from the head space of an automobile fuel tank, forcing the vapors out through the filler pipe into the atmosphere. The air pollution resulting from this situation is undesirable. Currently, many fuel dispensing pumps at service stations are equipped with vapor recovery systems that collect fuel vapor in the fuel tank filler pipe during the fueling operation and transfer the vapor to a fuel storage tank. Many of these systems include a vapor pump to positively move vapor from the filler pipe to the service station's fuel tanks and are commonly referred to as vacuum assist systems.

Recently, onboard, or vehicle-carried, fuel vapor recovery and storage systems (commonly referred to as onboard recovery vapor recovery, or ORVR) have been developed, in which the head space in the vehicle fuel tank is vented through an activated carbon filled canister so that the vapor is adsorbed by the activated carbon. Subsequently, the fuel vapor is withdrawn from the canister into the engine intake manifold for mixture and combustion with the normal fuel and air mixture.

In typical ORVR systems, a canister outlet is connected to the intake manifold of the vehicle engine through a normally closed purge valve. The canister is intermittently subjected to the intake manifold vacuum with the opening and closing of the purge valve between the canister and intake manifold. A computer which monitors various vehicle operating conditions controls the opening and closing of the purge valve to assure that the fuel mixture established by the fuel injection system is not overly enriched by the addition of fuel vapor from the canister to the mixture. An example of an ORVR system is described in U.S. Pat. No. 4,887,578 to Woodcock et al.

Fuel dispensing systems having vacuum assisted vapor recovery capability which are unable to detect ORVR systems ingest excessive air into the underground storage tank and cause excessive pressure build-up in the underground storage tank due to the delivery of air rather than fuel vapor. The air causes further liquid fuel vaporization leading to "vapor growth." Recognizing an ORVR system and adjusting the operation of the fuel dispenser's vapor recovery system accordingly eliminates the redundancy and problems associated with operating two vapor recovery systems for one fueling operation. The problem of incompatibility of assisted vapor recovery and ORVR was discussed in "Estimated Hydrocarbon Emissions of Phase II and Onboard Vapor Recovery Systems" dated Apr. 12, 1994, amended May 24, 1994, by the California Air Resources Board. That paper suggests the use of a "smart" interface on a nozzle to detect an ORVR vehicle and prevent the return of vapors through the nozzle when an ORVR vehicle is being filled.

Adjusting the operation of the fuel dispenser's vacuum assist vapor recovery system will mitigate fugitive emissions by reducing underground tank pressure. Reducing underground tank pressure minimizes the "breathing" associated with pressure differentials between the underground tank and ambient pressure levels. If the vacuum created by the fuel dispenser's vapor recovery system is not reduced or shut off, the underground tank pressure will increase with the result that hydrocarbons will be released through piping leaks or a pressure vacuum valve or breathing cap associated with the underground tank.

Thus, there remains a need for a fuel dispensing system with a vacuum assist vapor recovery nozzle having the ability to adjust its vapor recovery system operation when an ORVR system is present on the vehicle being fueled to reduce breathing losses, as well as conserve energy. Such a system should include both a nozzle to detect the presence of the ORVR-equipped vehicle and a provision for modifying the operation of a vacuum assist system when such a vehicle is detected by the nozzle.

SUMMARY OF THE INVENTION

The present invention relates to a nozzle which responds to the presence of an ORVR-equipped vehicle by adjusting the operation of a vacuum assist vapor recovery system. The system may be installed on new nozzles or may be retrofitted in kit form on existing nozzles as needed. The invention has few moving parts and can be adapted to a variety of different types of vehicle fuel tank fill pipes.

In its simplest form the present invention includes a vapor recovery nozzle having a vapor passage in its nozzle spout and a plurality of vapor inlets in communication with the vapor passage. The spout includes a moveable seal or adapter mounted on the spout with the seal having a first position adjacent to the plurality of vapor inlets and a second position covering the vapor inlets so as to substantially block the passage of vapors through the vapor inlets. The seal may be biased in the second position. As used herein, "seal" is not intended to be limited to a perfect airtight-type seal, but rather a cover on the vapor inlets sufficient to inhibit most of the flow through the inlets than would otherwise occur.

The seal biasing can be accomplished in several ways. Preferably, the seal is biased in the second position by a coil spring or, alternatively, by a flexible bellows.

The present invention also provides an apparatus for dispensing fuel to a vehicle having a fuel tank with a fill neck and detecting an ORVR vehicle. The apparatus includes a vacuum assist nozzle for delivering fuel to a vehicle fuel tank with the nozzle including (i) a vapor return path for removing fuel vapor expelled from the fuel tank during a fueling operation, (ii) a spout having vapor inlets in communication with the vapor return path, and (iii) a moveable seal member mounted on the spout and covering the vapor inlets. The apparatus further includes a fill neck adapted to accept the spout without engaging the moveable seal. The apparatus could further include a restriction device mounted in the fill neck. This restriction device has an aperture sized to receive the spout and to block entry of the moveable seal, thus causing the seal to expose the vapor inlets.

The present invention also comprises a system for detecting a vehicle having an ORVR system when the spout of a vacuum assist nozzle is inserted into a vehicle fuel tank fill neck. The system comprises a moveable seal slidably mounted on the spout, the seal having (a) a first position which substantially blocks the return of vapors through a nozzle vapor passage; and (b) a second position which permits the return of vapors through the nozzle vapor passage. The moveable seal is biased in the second position when placed in the fill neck of a vehicle having an ORVR system and is moved to the first position when placed in the fill neck of a vehicle not having an ORVR system.

The present invention also relates to a fuel dispenser installation comprising a nozzle having a fuel delivery passage and a vapor return passage including a vapor intake port, a fuel delivery line to deliver fuel from a tank to a vehicle through the fuel delivery passage of said nozzle a vapor return line from the vapor return passage of the nozzle to the repository and including a pump to pump fuel vapor from the nozzle to the tank, an adapter on the nozzle. The adapter is constructed and arranged to cooperate with a vehicle fuel filler neck to selectively close the vapor intake port when an ORVR equipped vehicle is being fueled and to open the vapor intake port when a non-ORVR-equipped vehicle is being fueled. This embodiment may also incorporate modifying the operation of a vapor pump in communication with the vapor return passage when a non-ORVR vehicle is being fueled.

The present invention also relates to a method of recovering fuel vapor in a fuel dispensing installation including a nozzle having a fuel delivery passage and a vapor return passage having a vapor intake port, a vapor return line from the vapor return passage of the nozzle to a fuel tank and including a motor-driven pump to pump fuel vapor from the nozzle to the tank. The method comprises establishing a motor amperage value indicative of a blocked vapor return passage, monitoring the motor running amperage and comparing the motor running amperage to the blocked vapor return passage amperage. The operation of the vapor pump is modified if the motor running amperage exceeds the blocked vapor return passage amperage for a predetermined length of time. Fuel delivery is continued after modifying operation of the vapor pump.

Modifying the operation of the vapor pump may comprise either stopping operation of the vapor pump reducing the speed of the vapor pump to idle.

Therefore one aspect of the present invention is to provide a simple, low cost system for detecting an ORVR vehicle during a vehicle fueling operation.

Another aspect of the present invention is to provide a moveable seal slidably mounted on a vacuum assist vapor recovery nozzle to modify the operation of a vapor recovery system when the nozzle is used with an ORVR vehicle.

Yet another aspect of the present invention includes modifying the operation of the vapor pump responsive to the detection of an ORVR vehicle.

These and other aspects of the present invention will become apparent to those skilled in the art after a reading of the following description of the preferred embodiments when considered in conjunction with the drawings.

DESCRIPTION OF THE PREFERRED EMBODIMENTS

Figure 1:
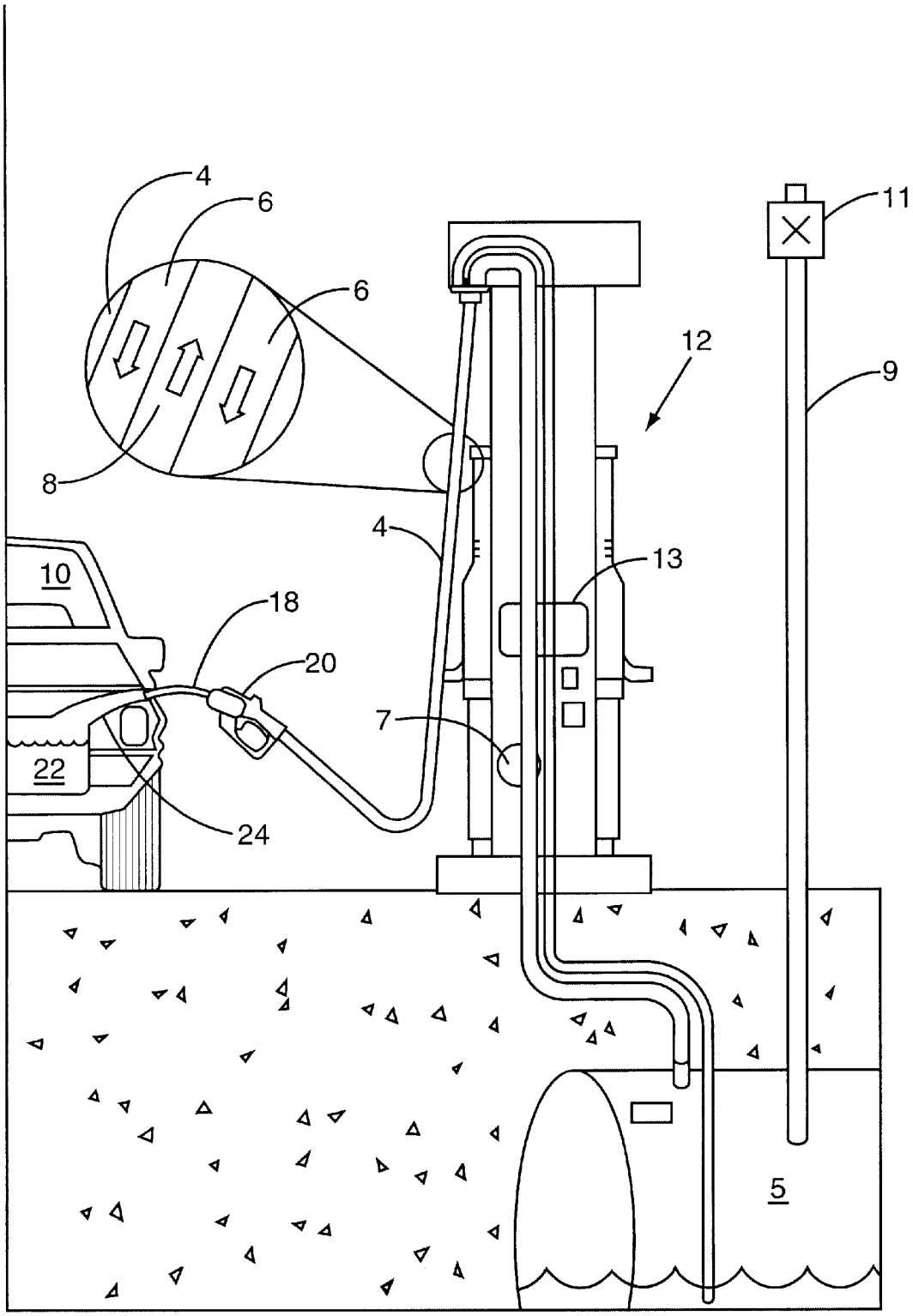
FIG. 1 is an elevation and partial sectional view of a typical gasoline dispenser having a vapor recovery system.

Referring now to the drawings in general, it will be understood that the illustrations are for the purpose of describing a preferred embodiment of the invention and are not intended to limit the invention thereto. As best seen in FIG. 1, in a typical service station, an automobile 10 is shown being fueled from a gasoline dispenser or pump 12. A spout 18 of nozzle 20 is shown inserted into a filler pipe 24 of a fuel tank 22 during the refueling of the automobile 10.

A fuel delivery hose 4 having vapor recovery capability is connected at one end to the nozzle 20, and at its other end to the fuel dispenser 12. As shown by the cutaway view of the interior of the fuel delivery hose 4, an annular fuel delivery passageway 6 is formed within the fuel delivery hose 4 for distributing gasoline pumped from an underground storage tank 5 to the nozzle 20. Also within the fuel delivery hose 4 is a tubular vapor recovery passageway 8 for transferring fuel vapors expelled from the vehicle's fuel tank 22 to the underground storage tank 5 during the fueling of a vehicle that is not equipped with an onboard vapor recovery system.

A vapor recovery pump 7 provides a vacuum in the vapor recovery passage 8 for removing fuel vapor during a refueling operation. The vapor recovery pump 7 may be placed along the vapor recovery passage 8 between the nozzle 20 and the underground fuel storage tank 5. The vapor recovery system using the pump 7 may be any suitable system such as those shown in U.S. Pat. No. 5,040,577 to Pope, U.S. Pat. No. 5,195,564 to Spalding, U.S. Pat. No. 5,333,655 to Bergamini et al., or U.S. Pat. No. 3,016,928 to Brandt. Various ones of these systems are now in commercial use, recovering vapor during refueling of conventional, non-ORVR vehicles. The present invention addresses an adaptation of the nozzles used with those systems for use with ORVR vehicles.

As shown in FIG. 1, the underground tank 5 includes a vent pipe 9 and a pressure-vacuum vent valve 11 for venting the underground tank 5 to atmosphere. The vent 9 and vent valve 11 allow the underground tank 5 to breathe, in order to substantially equalize the ambient and tank pressures. In typical applications, maintaining tank pressure between the limits of pressure and vacuum is sufficient. Typical ranges of pressure and vacuum will range between +3 inches of water to −8 inches of water.

Figure 2:
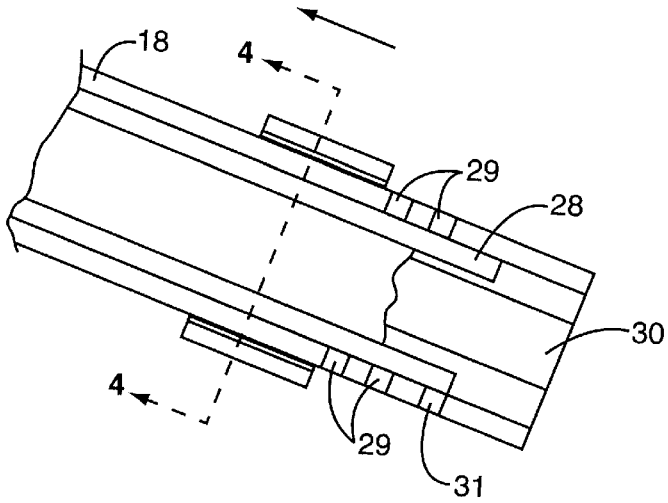
FIG. 2 is an elevation detail view of a nozzle spout fitted with the moveable seal of an embodiment of the present invention with the seal in its first, open position.
Figure 3:
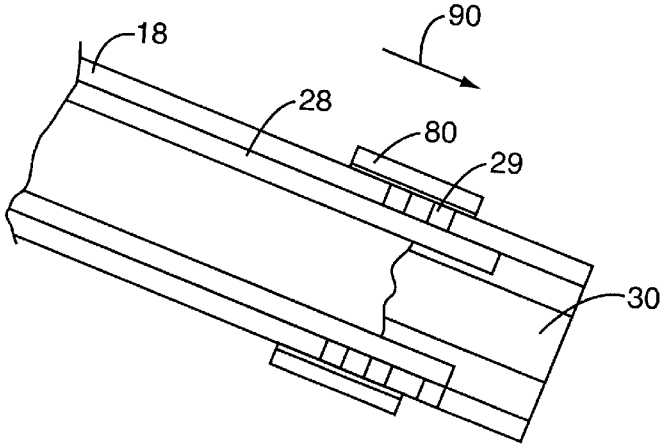
FIG. 3 is an elevation detail view of a nozzle spout fitted with the moveable seal of the embodiment of FIG. 2 with the seal in its second, closed position.

Turning now to FIGS. 2 and 3, a nozzle spout incorporating the present invention is shown in enlarged cross sectional detail. Spout 18 includes a fuel passage 30, which, in this embodiment, has a coaxial relationship with vapor passage 28. The plurality of vapor inlets 29 communicate with vapor passage 28 to provide a vapor return path through the spout, the nozzle body and thence to fuel delivery hose 4. The vapor inlets 29 allow fuel vapors to enter the vapor recovery path 8 of fuel dispenser 12 from the vehicle's filler pipe 24. As liquid fuel rushes into the fuel tank 22 during fueling of a vehicle not equipped with an ORVR system, fuel vapors are forced out of the fuel tank 22 through the fill pipe 24. The fuel dispenser's vapor recovery system pulls fuel vapor through the vapor inlets 29, along the vapor recovery path 8 and ultimately into the underground tank 5 (as shown in FIG. 1).

A moveable seal 80 is mounted on the spout in a slidable fashion as indicated by arrow 90. FIG. 2 shows the moveable seal 80 in its first position which is adjacent to the vapor inlets 29. FIG. 3 shows the moveable seal 80 in its second position where it substantially blocks the passage of vapors through the vapor inlets 29.

In this embodiment, the invention may further comprise at least one and as many as two seal stops (not shown) which prevent the moveable seal 80 from traveling past the end of the spout 18 and limit travel towards the nozzle body 20. The seal stops may take the form of projections extending laterally from the nozzle wall. Alternatively, the seal stops may comprise a ring attached to the exterior of the nozzle wall. The function of the latter seal stop may be provided by increasing the outside diameter of the spout in stepped fashion to create a shoulder for limiting seal stop travel.

The moveable seal 80 functions to block the passage of vapors through the vapor inlets 29, but need not create a perfect gas tight seal in order to do so. Indeed it is believed that some very small amount of gasoline vapors may still enter vapor inlets 29. In a preferred embodiment, the relationship between the moveable seal inside diameter and the outside diameter of the spout can be described as a slip fit. This relationship comprehends a close sliding contact sufficient to substantially block the passage of vapor through the vapor inlets 29. Typically, the clearance between the moveable seal and the spout 18 may be from about 0.002 in. to about 0.007 in. and preferably from about 0.002 in. to about 0.004 in. Other clearance dimensions up to about 0.020 in. may work if the length of the seal is increased so long as the vapor flow is blocked substantially and the seal slides in both directions along the spout without binding. The practice of the present invention also includes creating a perfect gas tight seal over vapor inlets 29. Again, however, it is not believed that such a seal is necessary for the proper functioning of the present invention.

The movable seal 80 may be fabricated of any rigid material suitable for the rigors of a service station or other type of fueling environment. Suitable materials include metal and engineered thermoplastics. Preferably, the material selected should be compatible with contact with petroleum products to include, but not be limited to, gasoline and diesel fuels. In a preferred embodiment, the moveable seal 80 is constructed from aluminum and has a thickness of about 0.063 in. to about 0.125 in. Alternatively, the seal could be comprised of a two piece assembly comprising an outer metal member surrounding an inner flexible seal constructed of a plastic rubber or rubber-like material. Although this two piece construction will function for the present invention, it is believed that the additional maintenance and material compatibility problems created by the use of the rubber-like material outweigh any performance advantages it may provide. It should be recognized that changing the material used to fabricate the seal may require altering the clearance dimension between the moveable seal 80 and the nozzle spout 18 in order to achieve a slip fit.

The spout may additionally include opening 31 typically located near the end of the spout for a conventional automatic shutoff feature of the nozzle. If used, this opening 31 should be positioned far enough away from the vapor inlets 29 so that the moveable seal does not cover opening 31 when it covers the vapor inlets 29. The spacing between opening 31 and the vapor inlets 29 may be adjusted as needed to ensure the proper functioning of the nozzle.

Figure 4:
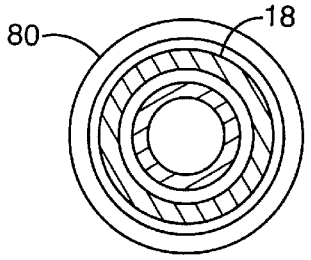
FIG. 4 is a sectional view taken along 4—4 of FIG. 2.

FIG. 4 is a sectional view taken along 4—4 in FIG. 2 to illustrate the relationship between the moveable seal 80 and the spout 18. The magnitude of the space between the inside diameter of the moveable seal 80 and the outside diameter of the spout 18 has been greatly increased for clarity.

The position of the moveable seal 80 during fueling is determined by the type of vehicle being refueled. For ORVR-equipped vehicles, moveable seal 80 is placed in the second position shown in FIG. 3 covering the vapor inlets. During fueling, the moveable seal 80 prevents air from being drawn into the vapor inlets 29 and ultimately into the underground fuel tank ullage. If desired, the electronics that control the vacuum pump may alter the operation of the pump to halt or slow the pump, as a result of the blockage. That aspect of the present invention is described in more detail below. If a vehicle without an ORVR system is to be fueled, moveable seal 80 may be pulled back along the nozzle spout to its first position as shown in FIG. 2. Thus, the vapor inlets 29 are exposed and will permit the vacuum assist vapor recovery system to remove vapors from the filler pipe 24 of the fuel tank 22. In this embodiment, the user must slide the moveable seal 80 along the nozzle spout to cover or expose the vapor inlets 29 as needed. While this embodiment functions adequately, it is not without its disadvantages.

First, users may find the need to manually slide the moveable seal 80 into the correct position objectionable. Moreover, some users may not know whether or not their vehicles are ORVR equipped and thus may fail to position the moveable seal 80 properly, leading to the creation of a potentially hazardous or environmentally undesirable situation.

Figure 5:
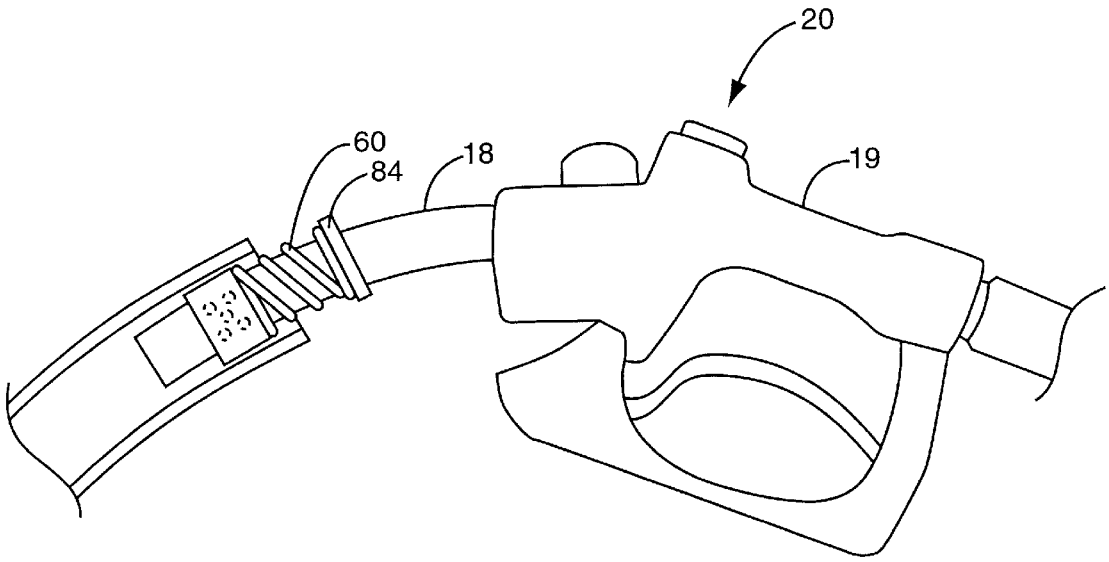
FIG. 5 illustrates the nozzle of the present invention inserted in the fill neck of a vehicle equipped with an ORVR system.

For these reasons, a preferred embodiment illustrated in FIG. 5 incorporates biased moveable seal 80 in the second position covering vapor inlets 29. In the embodiment of FIG. 5, the means for biasing is a coil spring 60 which is attached at a first end to the moveable seal 80 and at a second end to spring stop 84 affixed to the nozzle's spout. It can be seen that in the spring's normal extended position, the operation of a vacuum assist vapor recovery system will be interrupted because vapor inlets 29 have been covered. Thus, if the nozzle of the present invention is inserted into a vehicle having an ORVR system featuring a filler neck 24 that is wide enough to accept the width of moveable seal 80, the vapor recovery system will be effectively isolated from the vehicle tank. It is believed that some ORVR systems may incorporate some type of reduced diameter restriction device in the fuel tank filler neck 24. However, so long as the moveable seal 80 and any such restriction are sized so that the moveable seal may be received in the filler neck, the present invention will function to prevent the problems described herein above. It can be seen that the components of the present invention may be sized to accommodate a wide variety of tank fill neck configurations.

Figure 6:
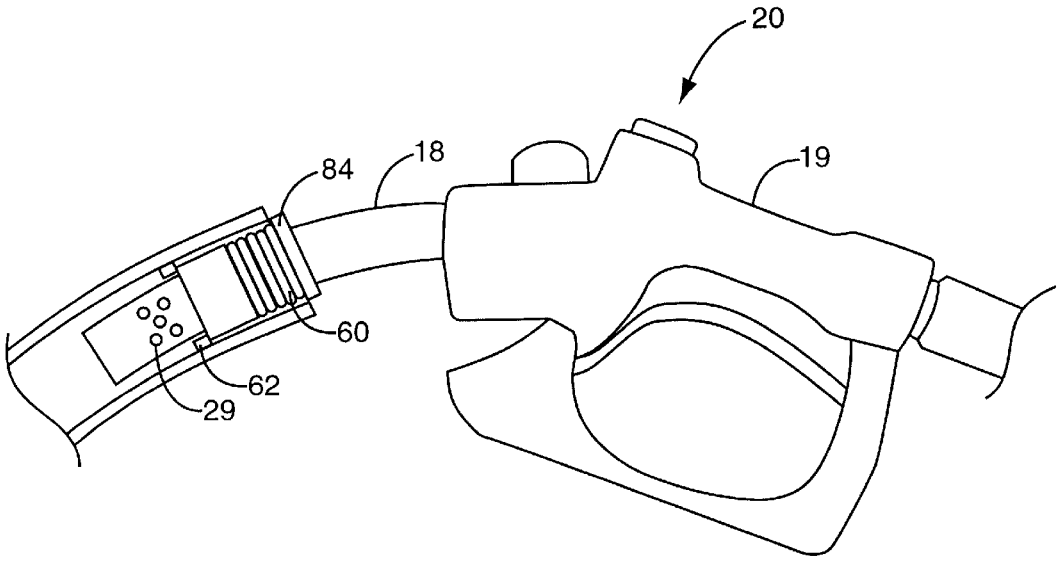
FIG. 6 depicts a typical vacuum assist vapor recovery nozzle and the cross section of a fuel tank of a vehicle not equipped with an ORVR system.

FIG. 6, illustrates the operation of the nozzle of the preferred embodiment for a vehicle not equipped with an ORVR system. The overwhelming majority of vehicles in use today are adapted to receive only unleaded fuel by the inclusion of a restricter plate 62 to define a small opening in the filler neck sized to accept unleaded fuel nozzles. Previously used leaded fuel nozzles were larger and would not fit into the unleaded fuel nozzle opening. As shown in FIG. 6, as an unleaded nozzle outfitted with the apparatus of the present invention is inserted into the filler neck opening, the moveable seal will engage the restricter plate 62 in the filler neck and be pushed back along the nozzle spout to expose vapor inlets 29 to permit the full functioning of the vacuum assist vapor recovery system. At the completion of the fueling operation as the nozzle is withdrawn from the filler neck 24, the spring 60 forces moveable seal 80 back into its second position covering vapor inlets 29. Although the present invention is here illustrated in the fill neck 24 of an automobile fuel tank, the invention will function in any fuel tank fill neck in which a restriction device is mounted and which has an aperture sized to receive the spout and to block entry of the moveable seal as the nozzle is inserted into the fill neck. Moveable seal 80 is biased in the second position when placed in the fill neck of a vehicle having an ORVR system and is moved to the first position when placed in the fill neck of a vehicle without an ORVR system.

Figure 7:
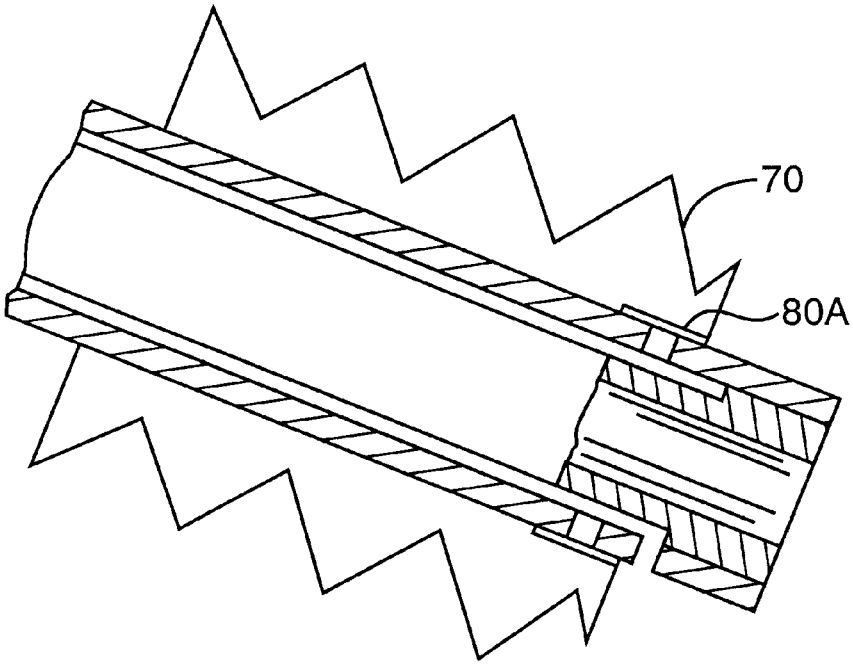
FIG. 7 shows a embodiment of the flexible bellows of the present invention.

FIG. 7, illustrates an alternate embodiment of the present invention wherein moveable seal 80 is biased by flexible bellows 70. Flexible bellows 70 is secured at one end to the nozzle spout 18. The moveable seal is secured at the opposite end of the bellows and is carried along the nozzle spout 18 by the spring-like action of the bellows. The bellows 70 may be constructed of any rubber, rubber-like or plastic material having spring constant characteristics similar to that of the spring 60 described above. The bellows material should be selected to be compatible with, among other things, gasoline, diesel fuel or any other type of fuel being dispensed by the nozzle. It is believed that a suitable bellows material is SANTOPRENE® thermoplastic rubber material sold by Monsanto. The selection of a material for flexible bellows 70 is within the ability of a person of ordinary skill in the art.

In an alternate flexible bellows embodiment (not shown) moveable seal 80 is formed as an integral part of the flexible bellows 70. In this embodiment, moveable seal 80 is constructed from the same material as that of the flexible bellows 70. This embodiment also features a slip fit between the moveable seal 80 and the spout 18 to ensure that the moveable seal 80 slides back and forth along spout 18 easily while still functioning to cover vapor inlets 29 in the fashion described herein above.

Although moveable seal 80 has been illustrated as a ring having a circular cross-sectional shape, other configurations may be used. The shape and structure of this element may be varied to accommodate a wide variety of situations.

Figure 8:
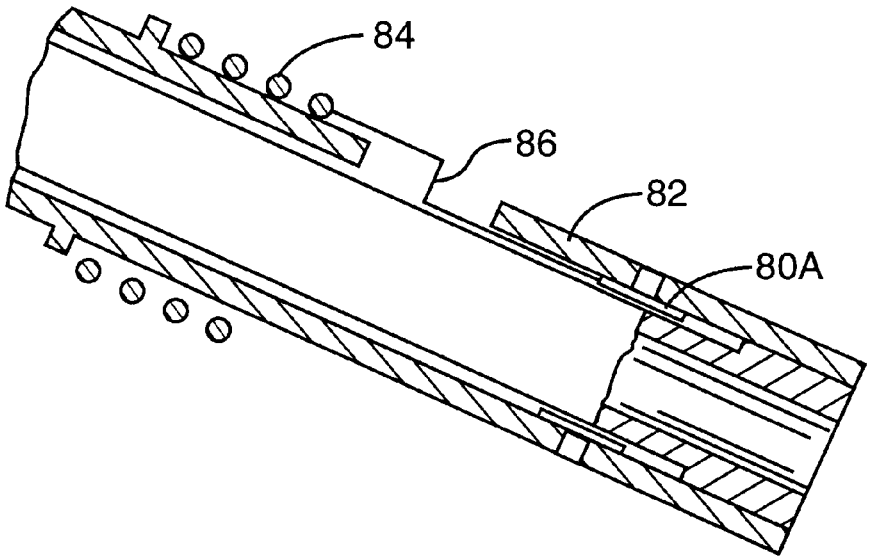
FIG. 8 shows the moveable seal of the present invention mounted internally within the nozzle spout vapor return passageway.

In another embodiment of the present invention, an internal moveable seal 80*a* may be positioned in the spout vapor passage 28 as illustrated in FIG. 8. Here the outside diameter of the seal is sized to have a slip fit with the inside diameter of the spout wall 82. The biasing force may originate from spring 84 which is attached to at least one mounting member 86. The member 86 travels through slot 88 in sliding engagement with some type of restriction device to operate moveable seal 80*a*. Obviously, the width of slot 88 should be as small as possible to prevent excessive vapor escape from vapor passage 28. Although this embodiment is illustrated with one member 86, the use of two members may be desirable to prevent the internal moveable seal 80*a* from binding in the vapor passage 28.

Figure 9:
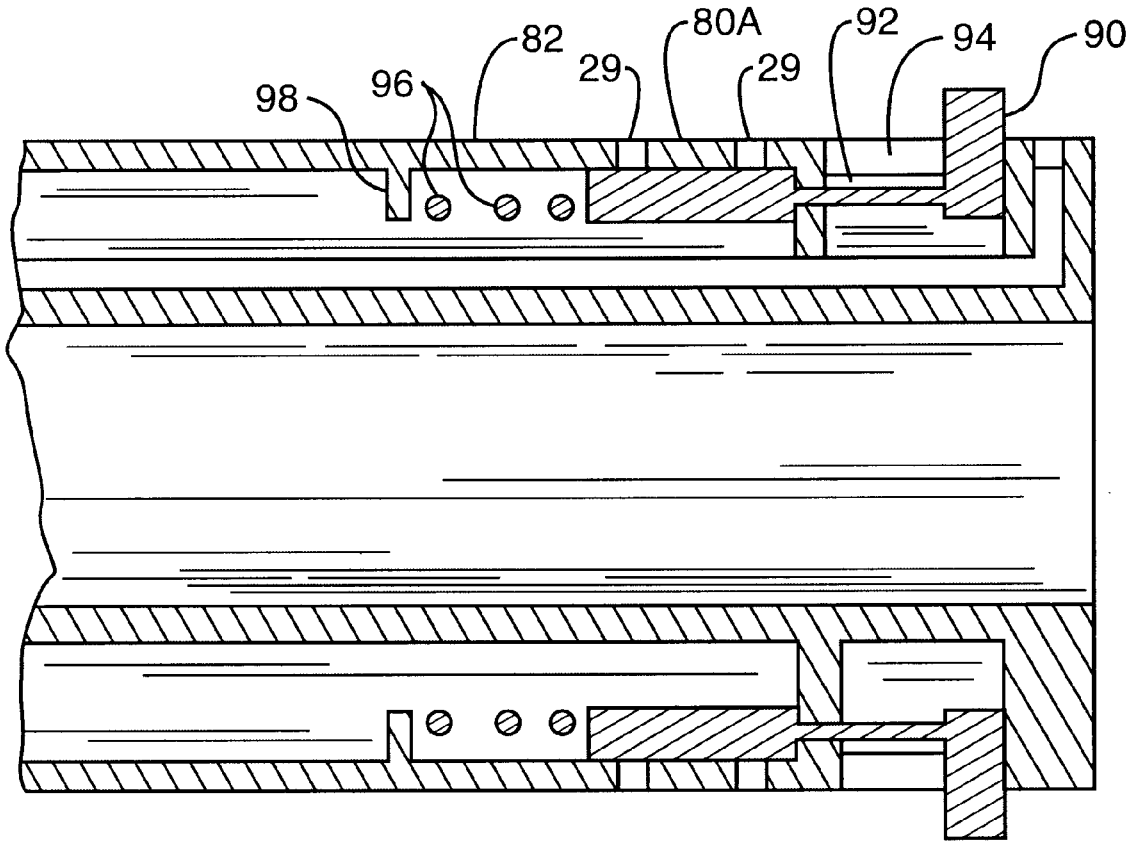
FIG. 9 shows an alternative internal moveable seal embodiment.

An alternative internal seal embodiment is depicted in FIG. 9. Moveable seal 80*a* has a slip fit relationship with the inside diameter of the spout wall 82. Spring 96 is held in place by spring stop 98 so as to provide a biasing force against internal movable seal 80*a*. The seal 80*a* is connected by at least one connecting member 92 to engaging member 90. In FIG. 9 the seal 80*a* is shown in position for use with an ORVR vehicle with vapor inlets 29 closed. As will be readily appreciated, when engaging member 90 is forced back by a suitable device in a non-ORVR automobile tank fill pipe, movable seal 80*a* is also moved in the same direction so as to expose vapor inlets 29. As the nozzle is removed from the tank fill pipe, the spring returns moveable seal 80*a* to a position covering vapor inlets 29.

Although the present invention has been described with the each type of biasing means holding the moveable seal 80*a* in a closed position, it is within the scope of the present invention to bias the seal in an open position. In this approach contact and sliding engagement with either some type of engaging member 90 or with the moveable seal 80 itself will cause the seal to move to a closed position. The choice between the two approaches will be dictated by the standards eventually adopted for ORVR vehicles and the design preference of a person of ordinary skill implementing the invention. It is believed that either approach is equally desirable and interchangeable.

The present invention provides several advantages for addressing the vapor recovery needs described herein. The invention is quite simple, having a minimum number of moving parts. Thus, the present invention is capable of discriminating between ORVR and non-ORVR vehicles without the need for expensive, hard to maintain magnetic devices or any type of electronics.

Additionally, the preferred embodiment of the present invention does not require the user to know whether or not a vehicle is equipped with an ORVR system to position the moveable seal correctly on the nozzle spout.

Adjusting the vapor flow created by the fuel dispenser's vapor recovery system prevents over pressurizing the underground fuel tanks, thus mitigating fugitive emissions. Fugitive emissions is a collective term for emissions from the vent 11 or any other leak path to the atmosphere at the dispensing facility.

The invention also encompasses kits, modules and the like for retrofitting pre-existing nozzles to enable ORVR equipped vehicle detection. A typical retrofit kit could include a moveable seal 80, a coil spring 60, spring stop 84 for anchoring the coil spring 60 to the nozzle spout, and/or at least one seal stop.

In each of the embodiments described above, the movable seal 80 prevents substantially all of the vapors from entering the nozzle vapor inlets 29. A closed space is thereby defined between the vapor pump inlet and the blocked vapor inlets 29. This space, depending on the positioning on the vapor pump, is roughly the length of the fuel delivery hose. If the vapor pump is permitted to continue to pull a vacuum against this dead space, damage to the pump or to other system components may occur. Thus, it is desirable to modify vapor pump operation responsive to this condition. Known systems for modifying vapor pump operation during automobile fueling are described in U.S. Pat. Nos. 5,269,353 and 5,355,915 ("the '915 patent") which share a common assignee with the instant invention. In the system disclosed in the '915 patent, the presence of fuel in the vapor return line which clogs the vapor inlets 29 for a predetermined amount of time causes the shutdown of the dispenser. However, in the practice of the present invention it is desirable to continue fuel delivery after this condition has been detected with only vapor pump operation being adjusted. The systems described above may have difficulty operating with the present invention because the moveable seal 80 could simulate the splash-back condition that would cause the '915 patent system to halt fuel delivery.

Figure 10:
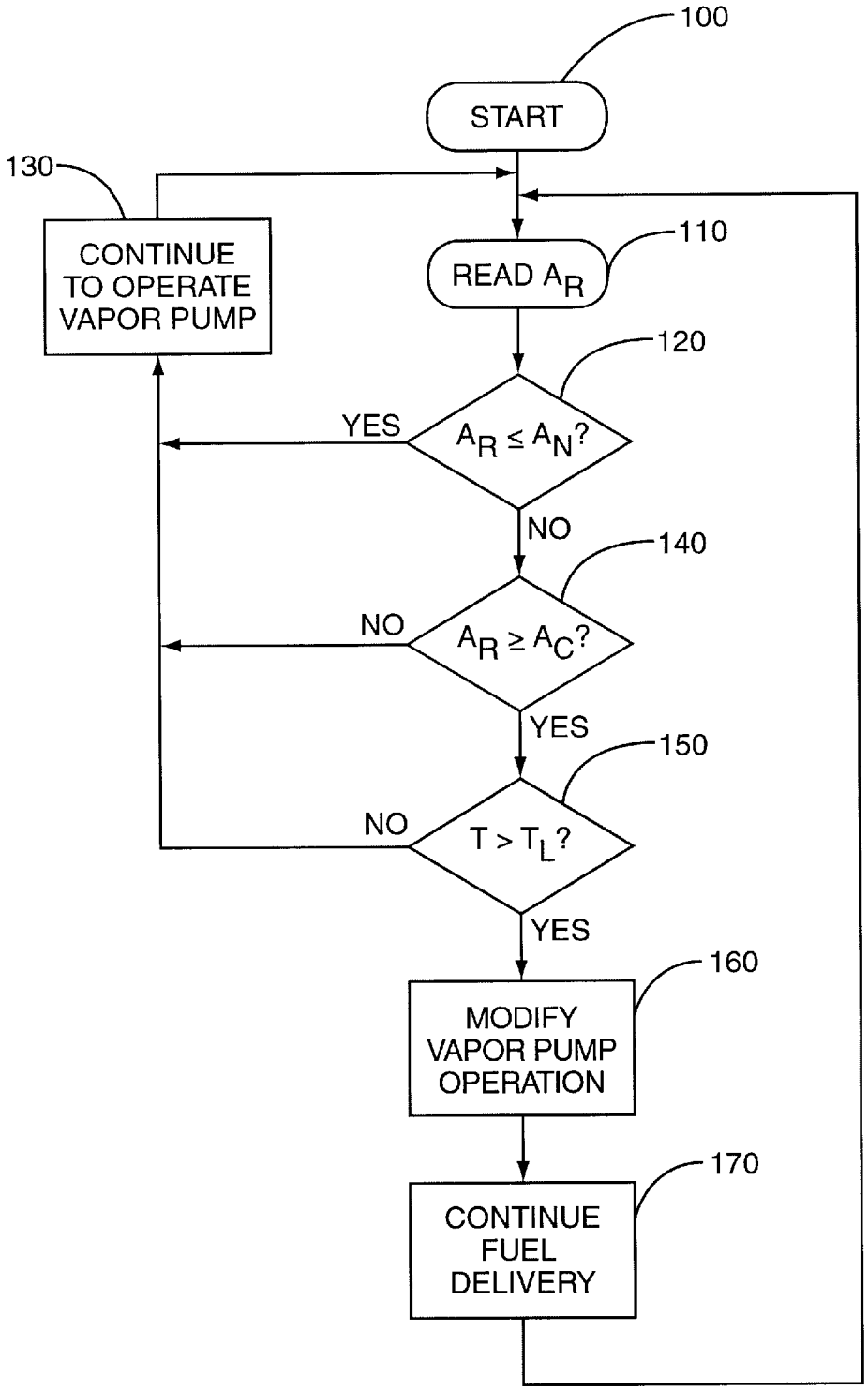
FIG. 10 is a schematic block diagram of a method for controlling the operation of a vapor pump responsive to the amperage drawn by the motor driving the pump.

A preferred method for addressing this situation is illustrated in the logic chart shown in FIG. 10. The control scheme shown in the chart is based on the electric motor driving vapor pump 7 (FIG. 1) having a normal operating amperage. ($A_N$) Another value may be established for the amperage drawn by the motor when the vapor line is closed by moveable seal 80. ($A_C$) Having established these values, the vacuum assist vapor recovery system is started at 100. Next at 110 the running amperage ($A_R$) supplied to the vapor pump motor is read. At decision block 120 $A_R$ is compared to $A_N$. If $A_R$ is equal to or less than $A_N$ indicating that the vapor return passageway 8 is unblocked, then the decision block returns to 130 and continues to operate vapor pump 7. If this decision block answers "No," then the process moves to decision block 140 where $A_R$ is compared to $A_C$. If $A_R$ is equal or greater than $A_C$, the process moves to decision block 150 where the amount of time that this condition has existed is determined and compared to a predetermined time limit. ($T_L$) Once $T_L$ has been exceeded, the operation of the vapor pump is modified as indicated at 160. This modification could include stopping the pump. However, fuel delivery continues 170 because the vapor path blockage was caused by moveable seal 80 detecting the presence of an ORVR vehicle and not by a transitory splash-back or any malfunction of the vapor recovery system. $T_L$ should be selected to exclude motor start-up transient amperages and excessive motor current caused by splash-back.

Other control options are available for the vapor pump when the conditions at decision blocks 140 and 150 are met. By way of non-limiting example, the vapor pump speed could be reduced to an idle speed such that the pump could continue to run without causing damage to the pump or to other system components.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

We claim:

1. A method of recovering fuel vapor in a fuel dispensing installation including a nozzle having a fuel delivery passage and a vapor return passage having a vapor intake port, a vapor return line from the vapor return passage of the nozzle to a fuel tank and including a motor-driven pump to pump fuel vapor from the nozzle to the tank, the method comprising:

a) establishing a motor amperage value indicative of a blocked vapor return passage;

b) monitoring the motor running amperage and comparing the motor running amperage to the amperage value from step a);

c) modifying operation of the vapor pump if the motor running amperage exceeds the amperage value from step a) for a predetermined length of time; and d) continuing fuel delivery after modifying operation of the vapor pump.

2. The method of claim 1 wherein the step of modifying the operation of the vapor pump comprises stopping operation of the vapor pump.

3. The method of claim 1 wherein the step of modifying the operation of the vapor pump comprises reducing the speed of the vapor pump to idle.

* * * * *